US005630278A

United States Patent [19]

Stoneberg

[11] Patent Number: 5,630,278

[45] Date of Patent: May 20, 1997

[54] CIRCLE COMPASS

[75] Inventor: Bruce Stoneberg, LaGrange, Ill.

[73] Assignee: Safe-T Products, Inc., LaGrange, Ill.

[21] Appl. No.: 412,049

[22] Filed: Mar. 28, 1995

[51] Int. Cl.[6] ..... B43L 9/20

[52] U.S. Cl. ..... 33/27.02; 33/558.04

[58] Field of Search ..... 33/27.01, 27.02, 33/27.03, 27.031, 27.032, 27.033, 558.01, 558.04, 558.05, 558.3, 558.1, 465, 495

[56] References Cited

U.S. PATENT DOCUMENTS

| | | | |
|---|---|---|---|
| 1,984,467 | 12/1934 | Des Roberts | 33/27.02 |
| 2,364,805 | 12/1944 | Nash | 33/558.01 |
| 3,308,538 | 3/1967 | Peck | 33/27.02 |
| 3,537,181 | 11/1970 | Graef | 33/27.02 |
| 3,683,505 | 8/1972 | Graef | 33/27.02 |
| 4,542,587 | 9/1985 | Emerson | 33/27.02 |

*Primary Examiner*—G. Bradley Bennett

*Attorney, Agent, or Firm*—Laff, Whitesel, Conte & Saret, Ltd.

[57] ABSTRACT

A device for forming circles that includes a first member which is rotatably attached to a second member. The first and second members include a first peripheral section and a second peripheral section, with one of the sections being arcuate. The first peripheral section of the first member is generally opposite the second peripheral section of the second member and the first peripheral section of the second member is generally opposite the second peripheral section of the first member. In one embodiment, the first peripheral section is arcuately curved and the second peripheral section is tapered. In another embodiment, the first peripheral section is arcuately curved and tapered and the second peripheral section is generally flat. Marking means are removably secured between the opposing sections of the first and second members.

12 Claims, 3 Drawing Sheets

CIRCLE COMPASS

FIELD OF THE INVENTION

This invention relates to compasses. More particularly, this invention relates to compasses for forming circles on surfaces.

BACKGROUND OF THE INVENTION

A variety of compass assemblies for forming circles about a given stationary point are known. These include conventional compass structures with v-shaped frames which are hinged at their apexes. Pointed stylus tips and/or sharp marking instruments are secured to the frames of these structures at different locations. In some assemblies, the marking instruments are inserted into short cylinders integrally formed with or otherwise attached to the v-shaped frames. The marking instruments are then retained within the cylinders by hinged elements.

While the above-described compasses provide means for forming circles on a given surface, there are problems associated with their use. For example, the hinged frames of conventional compasses readily loosen at their apexes. Because the pointed tips and the marking instruments (which are attached to the sides of the frames) are maintained in a predetermined spacing during usage, any undesired lateral movement within the frame structures results in the formation of asymmetrical circles. Since conventional frames do not include mechanisms for tightening the hinges of the frames, the compasses are often rendered useless as the hinges loosen over time.

Also, the elements which secure the marking instruments to the frames of conventional compasses frequently weaken with use. This, in turn, permits the marking instruments to drift axially during use. Such axial movement similarly interferes with proper usage of the compasses and may render the compasses inoperative.

Finally, conventional compasses cannot be disassembled during nonuse. Because compasses usually have sharp marking instruments and/or pointed stylus tips, they are potentially hazardous if stored in an assembled state.

Accordingly, an object of the present invention is to provide an improved compass for forming circles which does not employ V-shaped frames but generally includes a simple two-piece construction.

It is another object of the present invention to provide an improved two piece compass for forming circles which holds marking instruments with bottom portions in alignment with one another when the instruments are rotated to a zero radius position, and top portions which do not intersect one another when the marking instruments are rotated to increase the radii of the circles.

It is another object of the present invention to provide an improved compass for forming circles which restricts undesirable lateral and axial movement of the drawing instruments within the compass body during use.

It is another object of the present invention to provide an improved compass for forming circles which includes a stylus that is adjustable in length to accommodate drawing instruments that are shortened due to frequent sharpening.

It is yet another object of the present invention to provide an improved compass for forming circles which allows for the easy rotation of the marking instruments towards and away from one another.

It is a further object of the present invention to provide an improved compass for forming circles that is relatively inexpensive to manufacture.

Other objects and advantages of the invention will appear hereinafter.

SUMMARY OF THE INVENTION

The present invention, in a preferred embodiment, accomplishes the foregoing and other desirable objects by providing a compass for forming circles that comprises, in part, a first member and a rotatably attached second member. The first and second members include an arcuately curved section adjacent a portion of their periphery and a tapered section adjacent an opposite portion of their periphery. The arcuately curved section of the first member is generally opposite the tapered section of the second member, and the arcuately curved section of the second member is generally opposite the tapered section of the first member. The tapered sections of the first and second members cause the marking means to align with one another at one end when the first and second members are rotated to a zero radius position. Thus, when the first and second members are rotated to a near zero position, the marking means are again aligned and circles having small radii may be readily formed. Likewise, the tapered sections cause the marking means to pass one another at an opposite end when the first and second members are rotated to increase the radii of the circles.

In an alternate embodiment, the arcuately curved sections are tapered or angled and the adjacent peripheral sections are generally flat causing the marking means to align in the manner described in relation to the preferred embodiment.

Marking means are removably secured within a first channel and a second channel formed by the opposing sections of the first and second members. The marking means are adapted to slidably move within the channels for adjusting their length. At least one of the marking means comprises a stylus for establishing the center point of a circle. In one embodiment, the stylus comprises a rigid pointed member for piercing the surface onto which the circle is to be drawn. In another embodiment, the stylus comprises a retractable pointed member which slidably moves out of and into a protective barrel within the stylus during use and nonuse.

Securing means rotatably connect the first member to the second member in a rotatably adjustable position. The securing means permit the first and second members to be rotatably adjusted relative to one another without disturbing the marking means within the channels.

The above, as well as other objects and advantages of the invention, will become apparent from the following detailed description of the preferred embodiments, reference being made to the accompanying drawings.

DETAILED DESCRIPTION OF THE INVENTION

Figure 1:
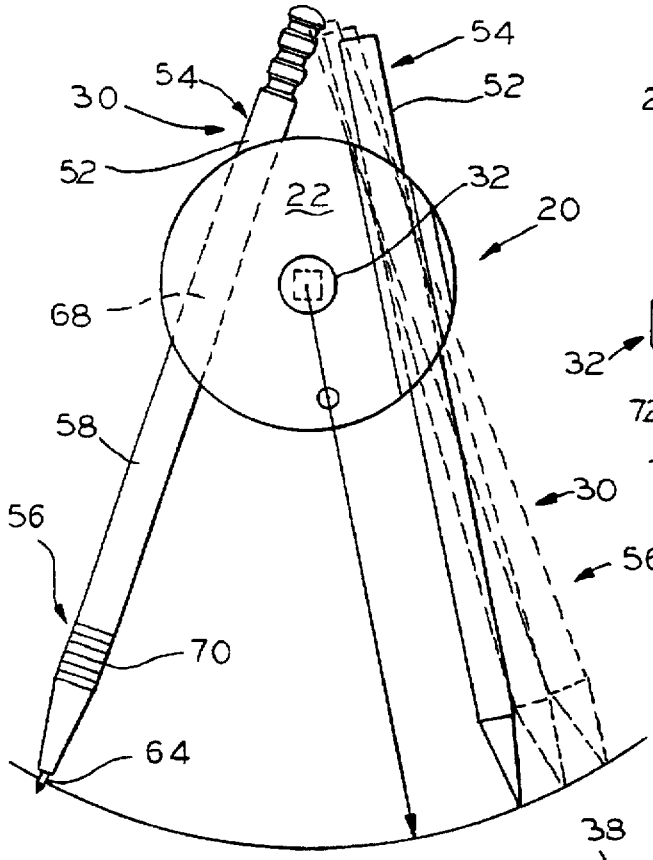
FIG. 1 is a side view of the inventive compass.

Generally referring to FIGS. 1–6, the invention provides a compass, denoted by the numeral 20, for forming circles on a surface, comprising, in part, a first member 22 and a rotatably attached second member 24. First and second members 22 and 24 include a first peripheral section 26 and a second peripheral section 28, with one of the sections being arcuate. Marking means 30 are removably secured between the first and second members. A securing means 32 secures first member 22 to second member 24 in a pre-selected position.

Figure 2:
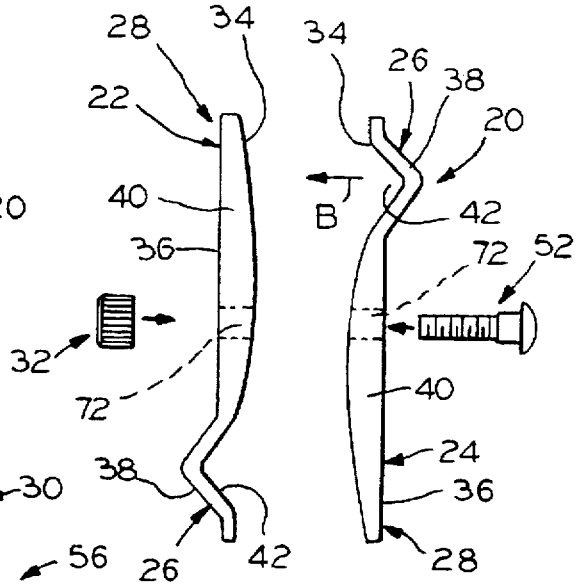
FIG. 2 is a top plan view of the preferred embodiment of the inventive compass, illustrating the positioning of the opposing members prior to their assembly.
Figure 4:
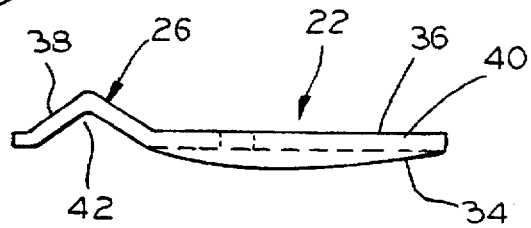
FIG. 4 is a top plan view of the opposing member, taken along lines 4—4 of FIG. 3.
Figure 5:
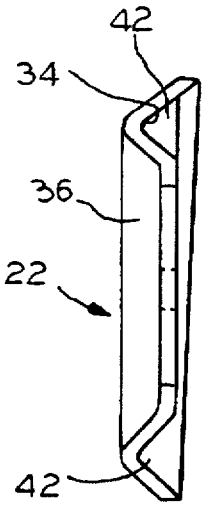
FIG. 5 is a perspective view of the opposing member, taken along lines 5—5 of FIG. 3.
Figure 3:
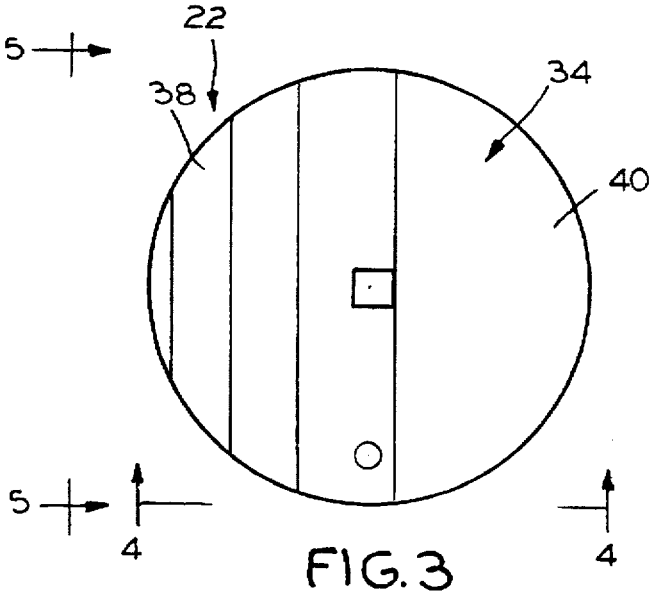
FIG. 3 is a side plan view of one of the opposing members of FIG. 2.
Figure 6:
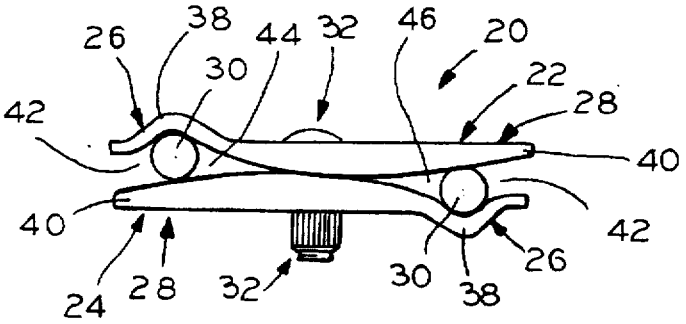
FIG. 6 is a top plan view of the compass of FIG. 1.

Referring to FIGS. 2 and 6, in a preferred embodiment first member 22 and second member 24 are generally identical discs that include an inner surface 34 and an outer surface 36. First member 22 and second member 24 include an arcuately curved section 38 adjacent a portion of their periphery and a tapered section 40 adjacent an opposite portion of their periphery. Arcuately curved section 38 is generally v-shaped with its open portion 42 forming a portion of inner surface 34 of the first and second members.

When assembled, first member 22 and second member 24 are positioned such that inner surfaces 34 of the two members are opposite one another, with arcuately curved section 38 of first member 22 being generally opposite tapered section 40 of second member 24, as shown by arrow A in FIG. 2. Likewise, arcuately curved section 38 of second member 24 is positioned generally opposite tapered section 40 of first member 22, as shown by arrow B in FIG. 2. First and second channels 44 and 46, respectively, are formed between the opposing arcuately curved and tapered sections of the members (FIG. 6).

Figure 7:
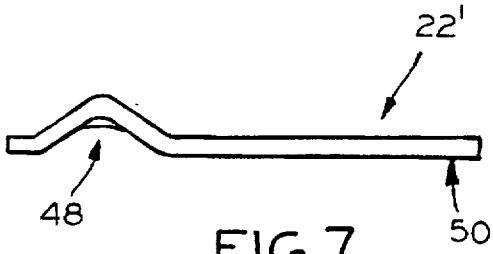
FIG. 7 is a top plan view of an alternate embodiment of the compass.

In an alternate embodiment, the inner surfaces of first and second members 22', 24' include a longitudinally tapered or angled arcuate section 48 adjacent a portion of their periphery and a generally flat section 50 adjacent an opposite portion of their periphery (FIG. 7). Tapered arcuate sections 48 of first and second members 22', 24' are positioned generally opposite flat sections 50, 50 and form first and second channels (when assembled) similarly to that described in the above preferred embodiment. Because first and second members 22' and 24' are identical, only member 22' is illustrated in FIG. 7.

Figure 8:
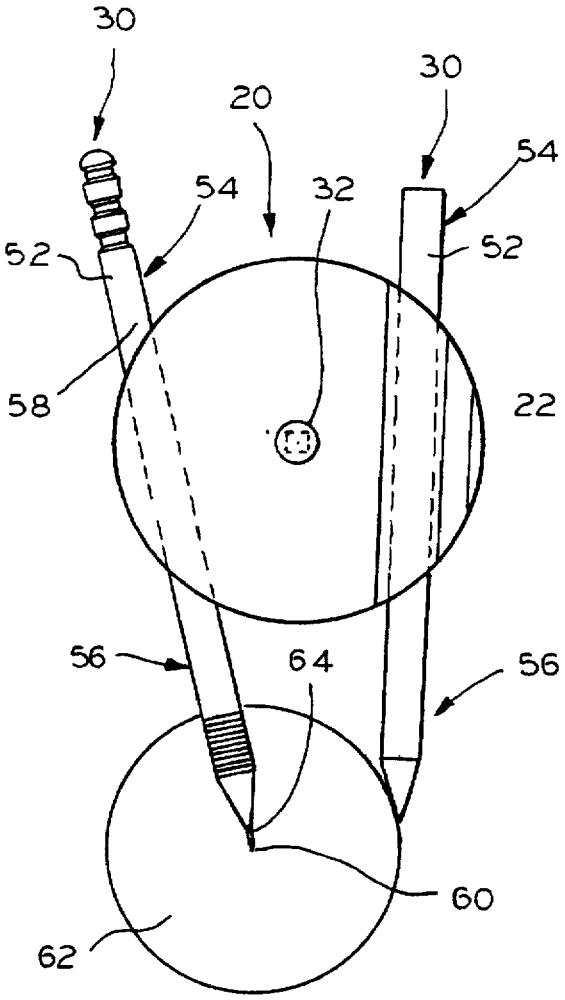
FIG. 8 is a side view of the compass of FIG. 1, illustrating the formation of a circle.
Figure 11:
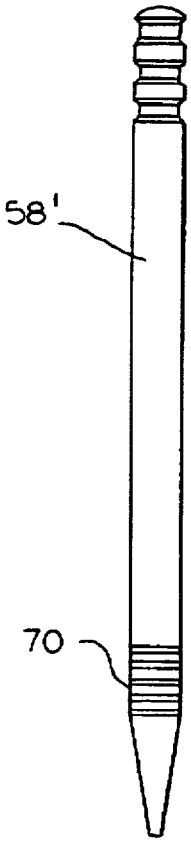
FIG. 11 is a side view of one embodiment of the stylus which is used with the compass, illustrating the pointed member in a retracted state.
Figure 12:
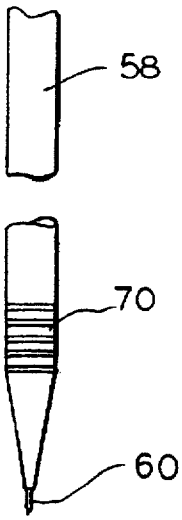
FIG. 12 is a fragmented view of the stylus of FIG. 11, illustrating the pointed member in a protracted state.

A marking means 30 is removably secured within first channel 44 and second channel 46 of both embodiments and includes a pair of marking instruments both denoted 52, and each having a top portion 54 and a bottom portion 56 (FIGS. 1, 8). At least one of marking instruments 52, 52 is a stylus 58 which establishes the center point 60 of a circle 62 and another of the marking instruments is a pen or pencil used for drawing the circle (FIG. 8). Stylus 58 comprises a rigid pointed member 64 which projects from bottom 56 for piercing the surface onto which the circle is to be drawn (FIG. 8). Alternatively, stylus 58' comprises a retractable pointed member 66 for similarly piercing the surface. Retractable pointed member 66 slidably moves out of and into a protective barrel (not shown) within the stylus during use and nonuse (FIGS. 11, 12).

Figure 13:
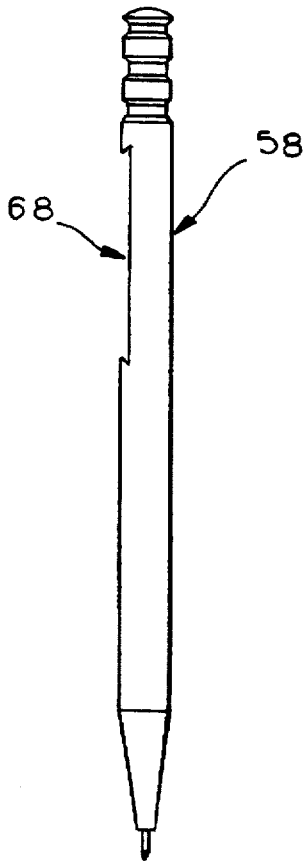
FIG. 13 is a side view of the stylus, illustrating the rabbet which securely engages the opposing member.

Stylus 58 preferably includes at least one rabbet 68 which extends longitudinally over a portion of its surface to prevent axial movement of the stylus within the channels of the first and second members (FIGS. 1, 13). Rabbet 68 securely engages inner surface 34 of first and second members 22, 24 when inserted into channels 44, 46 and includes dimensions that generally correspond to a portion of the contoured periphery of the members (FIG. 1). Stylus 58 may include a plurality of circumferentially extending ribs 70 along bottom portion 56 for gripping purposes (FIGS. 1, 11).

The pen or pencil used for forming circle 62 (FIG. 8) may vary in length. Thus, the tips of both short and long pens or pencils align with the stylus tip to form circles having large or small radii.

A securing means 32 rotatably secures first member 22 to second member 24 which, in turn, secures marking instruments 52, 52 within channels 44, 46 in a pre-selected position (FIG. 6). Securing means 32 protrudes through aligned holes 72, 72 in the first and second members and preferably comprises a threaded bolt and nut (FIG. 2). Securing means 32 may be loosened to rotate the first and second members and to movably slide marking instruments 52, 52 within channels 44, 46 to adjust their length. In addition, securing means 32, once tightened, permits the first and second members to be rotatably adjusted relative to one another without disturbing the marking instruments within the channels.

In use, marking instruments (such as, for example, a stylus and a pencil) are mounted between rotatably attached first and second members 22, 24. This involves loosening securing means 32 and inserting the marking instruments into downwardly tapered channels 44, 46. The first and second members are then rotated about securing means 32 until the desired spacing between the marking instruments is attained for forming a particular circle size. Then, the securing means are tightened to secure the marking instruments in the pre-selected position. The tightened securing means permit the first and second members to be rotatably adjusted relative to one another to increase or decrease the radius of a circle to be formed. Alternatively, the securing means may be repeatedly loosened for rotating the first and second members, as needed, to change the circle's radius. Additionally, the securing means may be loosened to axially move and adjust the length of the marking instruments within the channels. This includes loosening the securing means to completely remove the marking instruments for storage or to replace the marking instruments when necessary.

Figure 9:
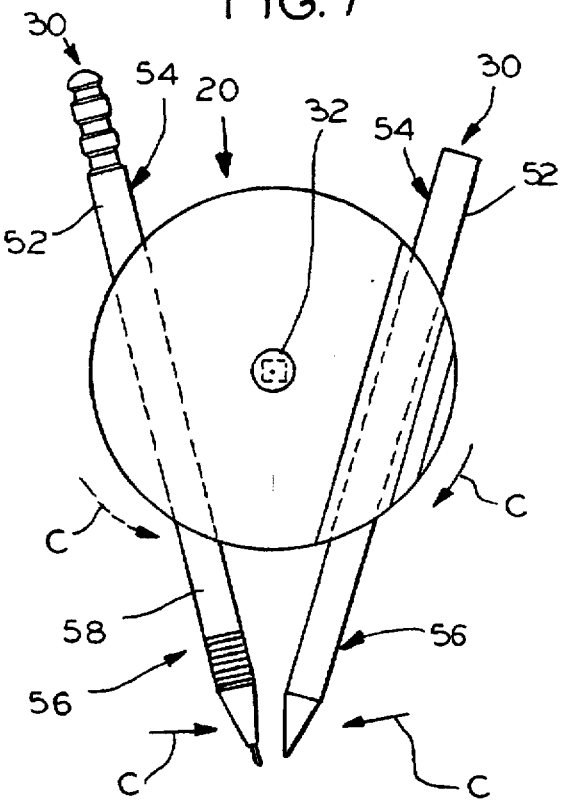
FIG. 9 is a side view of the compass of FIG. 1, illustrating the rotation of the marking instruments to a zero radius position.
Figure 10:
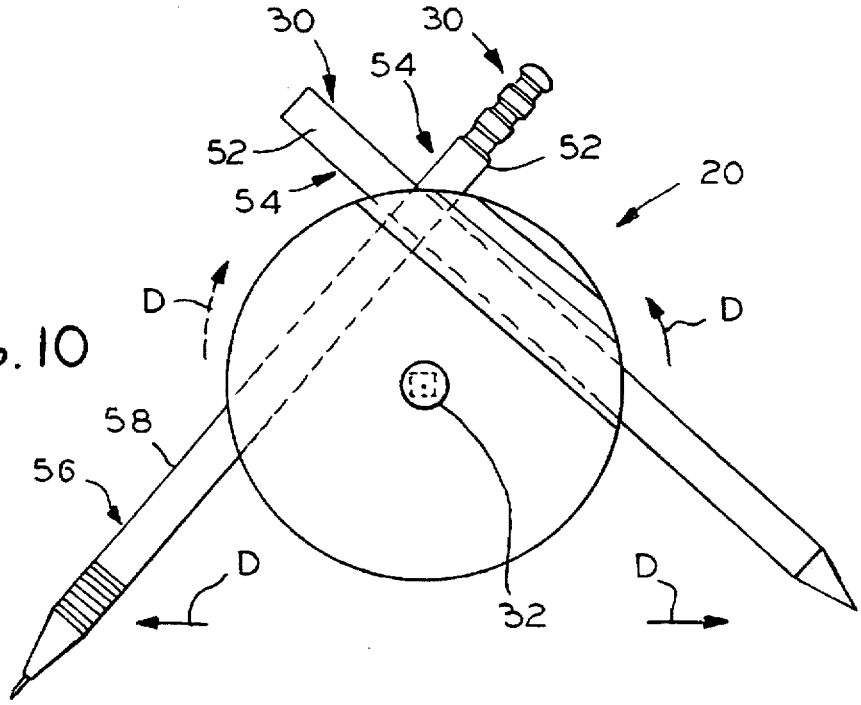
FIG. 10 is a side view of the compass of FIG. 1, illustrating the rotation of the marking instruments to increase the radius of the circle in size.

During use, when the first and second sections are rotated about securing means 32 to a zero radius position, the tapered sections (40, 40 in the preferred embodiment and 48, 48 in the alternate embodiment) cause the marking instruments secured within the channels of the members to align with one another at their bottom ends, as shown by the arrows C in FIG. 9. Thus, when the first and second sections are rotated to a near zero position, the marking instruments are again aligned and circles having small radii may be readily formed. Similarly, when the first and second sections are rotated to increase the radius of the circles, the tapered sections of the channels cause the marking instruments to pass one another at their top portions, as shown by the arrows D in FIG. 10.

The marking instruments may be removed and the first and second members may be disengaged from one another for storage.

The material from which compass 20 is constructed preferably is any hard plastic but may also include any other suitable material. Moreover, compass 20 has not been described in terms of approximate measurements, as it should be understood that the dimensions of the compass may vary according to need.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the scope and spirit of the invention.

The invention claimed is:

1. A device for forming circles on a surface comprising:

a first member and a rotatably attached second member, said first member and said second member each having a first peripheral section and a second peripheral section with one of said peripheral sections being arcuate and one of said peripheral sections being tapered, said first peripheral section of said first member being generally opposite said second peripheral section of said second member, and said first peripheral section of said second member being generally opposite said second peripheral section of said first member;

marking means removably secured between said opposing sections of said first and second members; and means for securing said first member to said second member in a pre-selected position.

2. The device of claim 1 wherein said first peripheral sections of said first and second members are arcuately curved and form first and second channels with said second peripheral sections of said members within which said marking means are secured.

3. The device of claim 2 wherein said second peripheral sections of said first and second members are tapered causing said marking means secured within said channels to align with one another at one end when said first and second members are rotated to a zero radius position and to pass one another at an opposite end when said first and second members are rotated to increase the radius.

4. The device of claim 2 wherein said arcuately curved first peripheral sections of said first and second members are tapered to align said marking means secured within said channels with one another at one end when said first and second members are rotated to a zero radius position and to pass one another at an opposite end when said first and second members are rotated to increase the radii of the circles in size.

5. The device of claim 1 wherein said securing means protrude through aligned holes in said first and second members.

6. The device of claim 5 wherein said securing means comprise a threaded bolt and nut.

7. The device of claim 1 wherein at least one of said marking means comprises a stylus with a rigid pointed member for piercing the surface onto which the circle is to be drawn.

8. The device of claim 7 wherein said stylus comprises a retractable pointed member for piercing the surface onto which the circle is to be drawn, said retractable pointed member slidably moving into and out of a protective barrel.

9. The device of claim 7 wherein said stylus includes a rabbet which fixedly engages an inner surface of said first or second members for preventing axial movement of said stylus between said members.

10. The device of claim 1 wherein said first and second members comprise discs.

11. A device for forming circles on a surface said device comprising:

a first member and a rotatably attached second member, said first and second members having arcuately curved sections adjacent a portion of their periphery and tapered sections adjacent an opposite portion of their periphery, said arcuately curved section of said first member being generally opposite said tapered section of said second member, and said arcuately curved section of said second member being generally opposite said tapered section of said first member;

marking means removably secured within a first channel and a second channel formed by the opposing sections of said first and second members, said tapered sections of said first and second members being configured to cause said marking means secured within said channels to align with one another at one end when said first and second members are rotated to a zero radius position and to pass one another at an opposite end when said first and second members are rotated to increase the radii of the circles in size; and means for securing said first member to said second member in a pre-selected position.

12. A device for forming circles on a surface said device comprising:

a first member and a rotatably attached second member, said first and second members each having an arcuately curved and tapered section adjacent a portion of their periphery and a substantially flat section adjacent an opposite portion of their periphery, said arcuately curved and tapered section of said first member being parallel to and opposite said flat section of said second member, and said arcuately curved and tapered section of said second member being parallel to and opposite said flat section of said first member;

marking means removably secured within a first channel and a second channel formed by the opposing sections of said first and second members, said arcuately curved and tapered sections of said first and second members being configured to cause said marking means secured within said channels to align with one another at one end when said first and second members are rotated to a zero radius position and to pass one another at an opposite end when said first and second members are rotated to increase the radii of the circles in size; and means for securing said first member to said second member in a pre-selected position.

* * * * *

UNITED STATES PATENT AND TRADEMARK OFFICE

CERTIFICATE OF CORRECTION

PATENT NO. : 5,630,278

DATED : May 20, 1997

INVENTOR(S) : Bruce Stoneberg

It is certified that error appears in the above-indentified patent and that said Letters Patent is hereby corrected as shown below:

Drawings:

Replace Fig. 2 with attached sheet Fig. 2.

Replace Fig. 12 with attached sheet Fig. 12.

Signed and Sealed this

Twenty-sixth Day of August, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,630,278
DATED : May 20, 1997
INVENTOR(S) : Bruce Stoneberg

It is certified that error appears in the above-indentified patent and that said Letters Patent is hereby corrected as shown below:

"

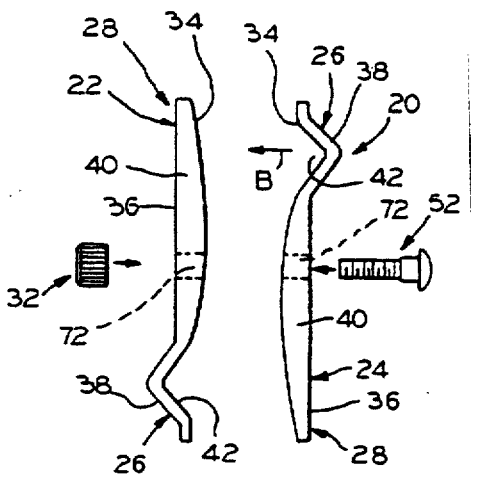

FIG. 2

"

with --

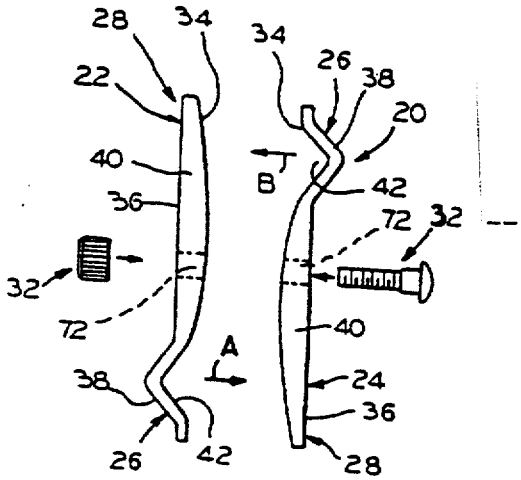

FIG. 2

--

UNITED STATES PATENT AND TRADEMARK OFFICE

CERTIFICATE OF CORRECTION

PATENT NO. : 5,630,278
DATED : May 20, 1997
INVENTOR(S) : Bruce Stoneberg

It is certified that error appears in the above-indentified patent and that said Letters Patent is hereby corrected as shown below:

" 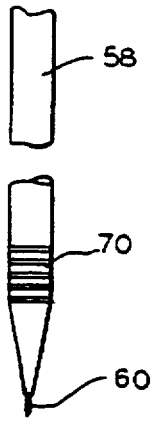

FIG.12 " with -- 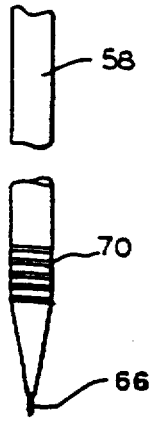

FIG.12 --